US010829974B2

(12) United States Patent
Letonje et al.

(10) Patent No.: US 10,829,974 B2
(45) Date of Patent: Nov. 10, 2020

(54) ROLLER SHUTTER ARRANGEMENT WITHOUT POLYGONAL EFFECT

(71) Applicant: EFAFLEX INŽENIRING d.o.o. Ljubljana, Ljubljana (SI)

(72) Inventors: Jurij Letonje, Mengeš (SI); Andrej Mazej, Vodice (SI); Jurij Žumer, Ljubljana (SI)

(73) Assignee: EFAFLEX INŽENIRING d.o.o. Ljubljana, Ljubljana (SI)

( * ) Notice: Subject to any disclaimer, the term of this patent is extended or adjusted under 35 U.S.C. 154(b) by 238 days.

(21) Appl. No.: 15/743,860

(22) PCT Filed: Jul. 21, 2016

(86) PCT No.: PCT/EP2016/067419
§ 371 (c)(1),
(2) Date: Jan. 11, 2018

(87) PCT Pub. No.: WO2017/021170
PCT Pub. Date: Feb. 9, 2017

(65) Prior Publication Data

US 2018/0202210 A1 Jul. 19, 2018

(30) Foreign Application Priority Data

Jul. 31, 2015 (DE) ..... 10 2015 112 633

(51) Int. Cl.
*E05D 15/24* (2006.01)
*E05F 15/668* (2015.01)

(52) U.S. Cl.
CPC ..... *E05D 15/246* (2013.01); *E05D 15/24* (2013.01); *E05F 15/668* (2015.01);
(Continued)

(58) Field of Classification Search
CPC ..... E05D 15/246; E05D 15/24; E05F 15/688; E05Y 2201/684; E05Y 2201/688; E05Y 2900/106
(Continued)

(56) References Cited

U.S. PATENT DOCUMENTS 1,897,391 A * 2/1933 Kelly ..... E05D 15/246 160/189
1,921,193 A * 8/1933 Kelly ..... E05D 15/24 160/209
(Continued)

FOREIGN PATENT DOCUMENTS

DE 40 15 215 A1 11/1991
DE 103 25 236 A1 12/2004
(Continued)

*Primary Examiner* — Katherine W Mitchell
*Assistant Examiner* — Jeremy C Ramsey
(74) *Attorney, Agent, or Firm* — McGlew and Tuttle, P.C.

(57) ABSTRACT

A roller shutter arrangement (1) includes a door leaf (2) including door leaf elements connected together to be angled and guided by guide rollers (23*a*, 23*b*) in lateral guides. The lateral guides each include an end portion accommodating the door leaf (2) in a closed position and a storage portion accommodating the door leaf (2) in an open position. The end portion and the storage portion are angled with respect to each other and are connected via a transition portion (42). The transition portion (42) includes guide paths on guide rollers on which predetermined guide rollers roll with a guide length between guide rollers corresponding substantially to a partition defined by a breadth of the door leaf element or to an integer multiple thereof. The so-called polygonal effect is avoided and higher movement speeds of the door leaf (2) are enabled while the service life is simultaneously increased.

20 Claims, 11 Drawing Sheets

(52) U.S. Cl.
CPC ... *E05Y 2201/684* (2013.01); *E05Y 2201/688* (2013.01); *E05Y 2900/106* (2013.01)

(58) Field of Classification Search
USPC ..... 160/201, 209, 188, 189
See application file for complete search history.

(56) References Cited

U.S. PATENT DOCUMENTS

| | | | | |
|---|---|---|---|---|
| 2,227,571 | A * | 1/1941 | Clark | E05D 15/165 160/209 |
| 2,329,443 | A * | 9/1943 | Rowe | E05D 15/246 160/209 |
| 5,036,899 | A * | 8/1991 | Mullet | E05D 15/24 160/189 |
| 2005/0081737 | A1 * | 4/2005 | Smallwood | B60J 5/14 104/89 |

FOREIGN PATENT DOCUMENTS

| | | | |
|---|---|---|---|
| DE | 20 2014 104 547 | U1 | 5/2015 |
| EP | 1 820 928 | A2 | 8/2007 |
| EP | 1 923 533 | A2 | 5/2008 |
| WO | 00/60208 | A1 | 10/2000 |
| WO | 2014/114528 | A1 | 7/2014 |

* cited by examiner

ROLLER SHUTTER ARRANGEMENT WITHOUT POLYGONAL EFFECT

CROSS REFERENCE TO RELATED APPLICATIONS

This application is a United States National Phase Application of International Application PCT/EP2016/067419 filed Jul. 21, 2016, and claims the benefit of priority under 35 U.S.C. § 119 of German Application DE 10 2015 112 633.8, filed Jul. 31, 2015, the entire contents of which are incorporated herein by reference.

FIELD OF THE INVENTION

The invention relates to a roller shutter arrangement comprising a door leaf in the form of a casing of door leaf elements such as slats or sections which are connected with each other in a manner adapted to be angled and which are each guided in lateral guides by means of guide rollers, wherein the door leaf is motor-driven by a drive and is movable to and fro between an open position and a closed position, wherein the lateral guides each comprise an end portion in which the door leaf is accommodated in the closed position for closing a door opening and a storage portion in which the door leaf is accommodated in the open position, and wherein the end portion and the storage portion are angled with respect to each other and are connected with each other via a transition portion of the guides.

BACKGROUND OF THE INVENTION

Such roller shutter arrangements are applied in manifold manners in practice. They are used particularly often for closing garages, hall gateways, or the like. Also in the interior of buildings they are often used for separating different production areas from each other. For many applications the movement speed of such roller shutters is of particular importance since the efficiency of production flows and of the storage and transport logistics may depend thereon. Conventional sectional doors are moved at movement speeds between 0.3 and 0.5 m/s, with the upper limit for the movement speed being in practice approximately 1 m/s. If higher speeds are desired, the door leaf is usually not formed of sections, but of slats having less breadth. The door leaf is then constructed of smaller parts and is suited for higher speeds.

A reason for this is that the running smoothness of such door leaves is generally higher if the partition predetermined by the breadth of the door leaf elements is small and the transition radius is large. The so-called polygonal effect plays a role here, which occurs when a traction mechanism is not moved in a linear manner, but runs over a circular arc or some path of different curvature. In the case of roller shutters this is the case when the door leaf is moved to and fro between its open position and its closed position and passes a non-linear transition portion in this process. Due to the partition predetermined by the breadth of the door leaf elements they cannot follow the curved and/or bent shape of the transition portion of the guides precisely. Rather, the individual door leaf elements are angled against each other, so that the movement follows a polygon. Different effective radii then occur in the transition portion, and accordingly a periodic oscillation of the movement speed by a mean speed and/or nominal speed occurs. The result is undesired excitations in the longitudinal and transverse directions of the traction mechanism which lead to oscillations.

Since the door leaves of roller shutters as a rule do not constitute a rotary system, the individual door leaf elements are not connected directly with the drive. Here, the polygonal effect especially results in the occurrence of oscillations of the guide rollers and/or door leaf elements in the movement direction and in the aggravation of an optimum operation of these door arrangements. Substantial noise developments as well as strain for the door leaf components are related therewith, which has a disadvantageous effect on their service lives. Therefore, the maximum movement speed for opening and closing the door arrangement is restricted here.

WO 2014/114528 A1 has also dealt with these problems already. The shutter element of this state of the art comprises vertically oriented end portions of the lateral guides which end in the lintel region in a storage portion of spiral shape. In order to reduce the above-mentioned disadvantageous impacts of the polygonal effect in the transition region between these guide portions this document proposes to provide an additional guiding device which serves quasi as a further transition portion and guides the door leaf additionally. The basic problems of the generation of a polygon in this transition portion by the angling of the individual door leaf elements with respect to each other is, however, eliminated neither here in the transition portion nor for the following spiral portion of the lateral guides. This proposed solution was therefore of very restricted suitability for achieving a reduction of the polygonal effect.

Moreover, EP 1 923 533 A2 has also dealt with these problems. In the case of this roller shutter it is provided, in the light of the kinematic problems mentioned, that the door leaf is, in the course of the opening movement, guided from the vertical portions of the lateral guide via a transition portion into spirally extending guide rails in the lintel region and to thus enable touchless winding of the door leaf. Moreover, the polygonal effect occurring during the winding on a winding shaft and responsible for the development of noise and oscillations is also to be avoided. In practice, however, it has turned out that this is possible to a certain extent only since, again induced by the system, the breadth of the given slats and their angled position with respect to each other in the transition portion still result in a substantial oscillation of the movement speed of the individual slats by a mean speed. The related acceleration and deceleration effects at the individual door leaf elements lead to massive wear at the guide elements and to a substantial noise development. Conventionally, this can only be encountered by keeping the movement speed low.

SUMMARY OF THE INVENTION

An object of the present invention therefore is to improve a generic roller shutter arrangement such that the so-called polygonal effect is avoided at least to a large extent and higher movement speeds of the door leaf are thus enabled.

This object is achieved by a roller shutter arrangement with a transition portion of the guides that provides at least two respective guide paths on which predetermined guide rollers roll, such that a guide length between two guide rollers corresponds substantially to the partition defined by a breadth of a door leaf element or to an integer multiple thereof.

According to the invention it was recognized that the oscillation behavior of the movement speed by a nominal speed has its reason in the kinematics of the guide. Thus, the guide length between two observed guide rollers of the roller shutter arrangement changes depending on whether these guide rollers are moved in rectilinear guides or in a transition portion which mandatorily comprises a predetermined curvature, as a rule a constant radius. Since, however, the door leaf as a whole is operated at the predetermined nominal speed, the guide roller or slat speed in the transition portion of the guides first of all increases locally in comparison therewith, wherein, due to the oscillation behavior caused therewith, the local movement speed then also becomes lower than the nominal speed. The oscillation of the movement speed excited by this thus leads to acceleration and deceleration effects which are not only restricted to the transition portions of the guides, but also cause effects beyond that.

Tests in the course of the invention have further shown that the number of oscillations at the observed guide roller and/or at the corresponding door leaf element is equal to the number of door leaf elements of the door leaf which follow the observed guide roller and/or the door leaf element and enter the transition portion of the guides. The magnitude of the oscillations of the speed and of the acceleration depends on the nominal speed, the radius in the transition portion, and the partition.

For solving these problems the instant invention now provides for the first time an adjustment of the effective guide length between two guide rollers in the transition portion of the guides such that the effective guide length corresponds to the partition defined by the breadth of the door leaf element or to an integer multiple thereof. In accordance with the invention this is achieved in that, in the transition portion of the guides, at least two respective guide paths are provided on which predetermined guide rollers roll such that one part of them follows the one guide path and the other part of them follows the at least one other guide path. In the embodiment with two guide paths, adjacent guide rollers will then roll e.g. on the respectively other guide path.

According to the invention the guide rollers in the transition portion of the guide are therefore for the first time not guided altogether on one single guideway, but run on different paths, so that the increased length of path known in the state of the art is exactly avoided for the individual guide rollers in the transition section. The effective guide length in the movement direction of the door leaf as a whole can then be shortened. The door leaf elements may then kink against each other locally by a larger degree. The actual movement path to be run through for the individual guide rollers and/or door leaf elements therefore corresponds in accordance with the invention to that of a rectilinear guide, so that no acceleration or deceleration of the movement speed is caused. A polygonal effect is thus avoided reliably or at least suppressed to a large extent.

In this manner it is achieved in accordance with the invention that the disadvantageous oscillation of the speed in the movement direction known from the state of the art is eliminated. This improves the stability of the door leaf movement and renders it more uniform. At the same time, the periodic strains on the door leaf and door leaf individual constructional elements are reduced, so that they are subject to less wear and have longer service lives.

Furthermore, the invention may also be implemented in the case of restricted installation space in the lintel region since the providing of the at least two guide paths requires little space. The lintel height may thus be kept low with the roller shutter arrangement according to the invention, so that a larger clearance height, etc. remains. Thus, it is possible to implement so-called low lintel doors in a particularly advantageous manner.

Another advantage of the instant invention consists in that the noise development during operation of the roller shutter arrangement is also reduced distinctly. At the same time the roller shutter arrangement may therefore be operated at distinctly higher opening or closing speed than it was possible in the state of the art.

This applies especially also for so-called sectional doors whose door leaf elements have a larger breadth—and hence also a larger partition of the door leaf—than the slats of a slat door. Practical tests have shown that even the door leaf of a sectional door of this kind is movable with speeds of up to 2.5 m/s.

Thus, the transition portion of the guides may have at least two respective guideways arranged to be staggered laterally with respect to each other, wherein predetermined guide rollers at the door leaf elements are correspondingly staggered axially with respect to each other and engage in an assigned guideway. In this manner the basic idea of the invention can be put into practice constructionally with particularly little effort. Successive guide rollers at the door leaf may, for instance, be guided alternately on the one guideway and on the other guideway. At the same time, such guides in the form of guideways are characterized by an exact, reliable and stable design, which enables high running smoothness. It is thus possible to achieve even higher movement speeds for the operation of the door leaf. Moreover, wear is minor, so that long service lives of the constructional elements can be attained.

If the door leaf elements comprise additional guide rollers which are adapted to be angled by means of hinges and/or joints with respect to the adjacent guide rollers of the door leaf element and which roll, in the transition portion, on another guideway than the adjacent guide rollers, it is possible to guide the at least two guide paths closer together in the transition portion of the guides, so that the transition portion requires less installation space. Thus, it is possible to reduce and/or avoid the polygonal effect in a particularly reliable manner with little constructional effort.

Furthermore, it is also possible that one of the guide paths follows, in the transition portion of the guides, a constant transition radius between the end portion and the storage portion of the guides. Then, this guide path may be provided in a per se known manner like with a conventional roller shutter. It is only the at least one further guide path which has to be configured in deviation thereof. The effort for the production of the transition portion of the guides is then low.

Furthermore, one of the guide paths may, in the transition portion of the guides, be radially outside of a constant transition radius between the end portion and the storage portion of the guides. In the case of this construction the at least two guide paths may be positioned close together, so that the space requirement for the transition portion may be kept low. Moreover, this embodiment variant is associated with a particularly high running smoothness for the movement of the door leaf.

Alternatively or additionally one of the guide paths may, in the transition portion of the guides, be radially inside of a constant transition radius between the end portion and the storage portion of the guides. This kind of configuration has the advantage that the transition portion may be configured in a particularly compact manner since no radially outward protrusion is necessary for providing this guide path.

The polygonal effect may further also be avoided in a particularly reliable manner if the storage portion of the guides is of rectilinear design. Then, no cants of the individual door leaf elements occur, so that the effective guide length here corresponds automatically to the partition of the door leaf elements.

If the drive transmits the drive force to the door leaf in the region of a door leaf element, an approved drive system for a roller shutter arrangement of this kind may be resorted to, which is then characterized by a particularly high operating safety and reliability.

In this respect it is preferred if the drive transmits the drive force to the door leaf at a bottom-side door leaf element. This mode of operation has proved successful in practice and can be used in a particularly advantageous manner in connection with the instant invention.

The roller shutter arrangement may be designed as a quickly moving lifting door. This form of use is largely predominant in practice. Here, the advantages with respect to the high running smoothness and the long service life as well as especially the high operating speeds have a particularly favorable effect.

In the following, the invention will be explained in more detail in embodiments by means of the Figures of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
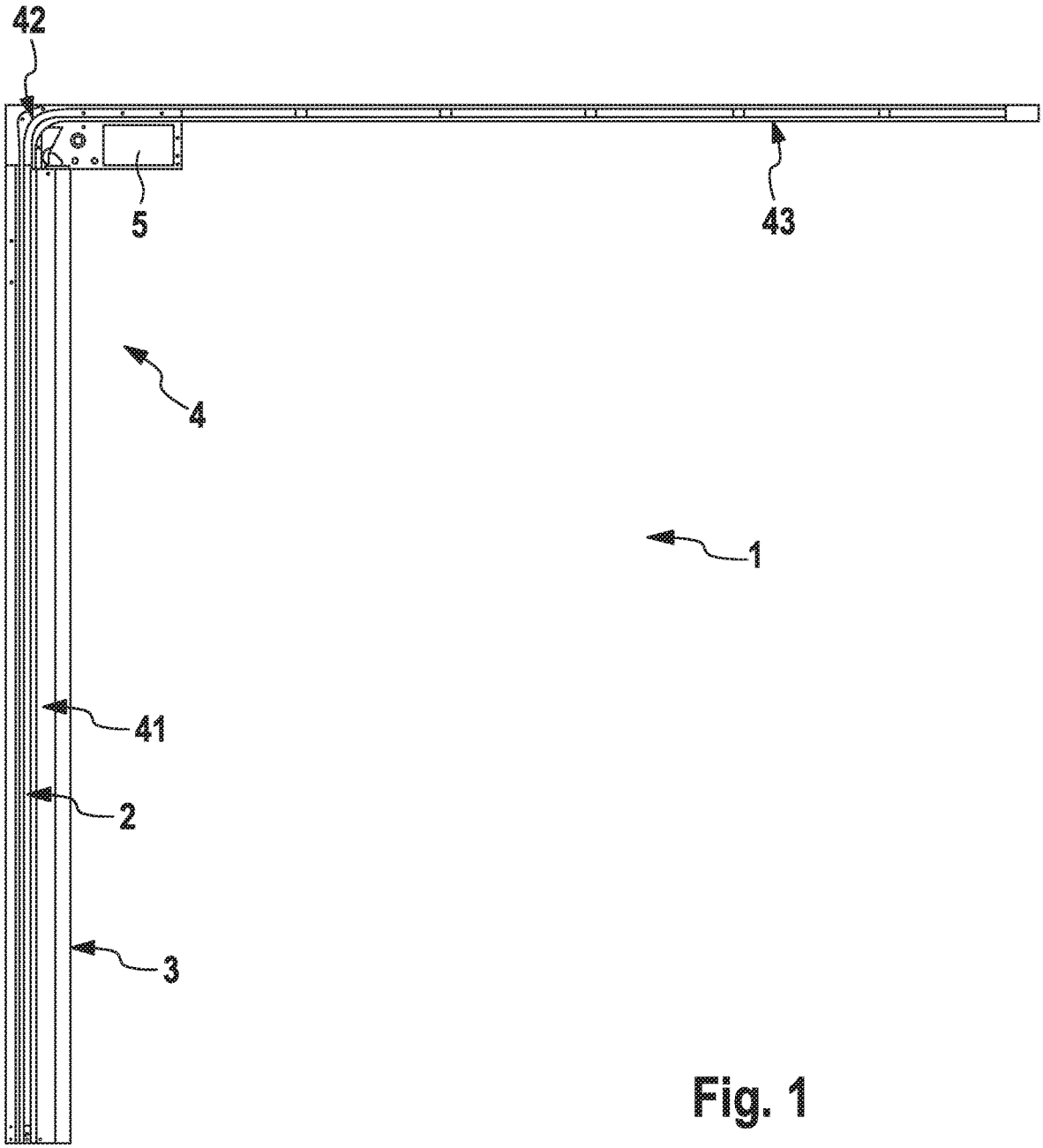
FIG. 1 is a side view of a roller shutter arrangement in accordance with the invention.

Referring to the drawings, FIG. 1 shows a sectional side view of a roller shutter arrangement 1 in accordance with the invention. It comprises a door leaf 2 which is guided on both sides in the region of a frame 3 in a guide 4. The door leaf 2 is motor-driven by a drive 5.

The guide 4 comprises an end portion 41 which is oriented vertically in the illustrated embodiment and accommodates the door leaf 2 being in its closed position. A transition portion 42 ending in a storage portion 43 follows this end portion 41. The storage portion 43 extends horizontally rectilinearly below the ceiling of a building which is not illustrated here. A guide of mirror-inverted design is also arranged at the opposite side of the door at a frame of corresponding design. The two guides thus accommodate the lateral ends of the door leaf 2 between themselves and guide same.

For opening the roller shutter arrangement 1 the door leaf 2 is moved from the end portion 41 via the transition portion 42 to the storage portion 43 where it remains in the open position.

Figure 2:
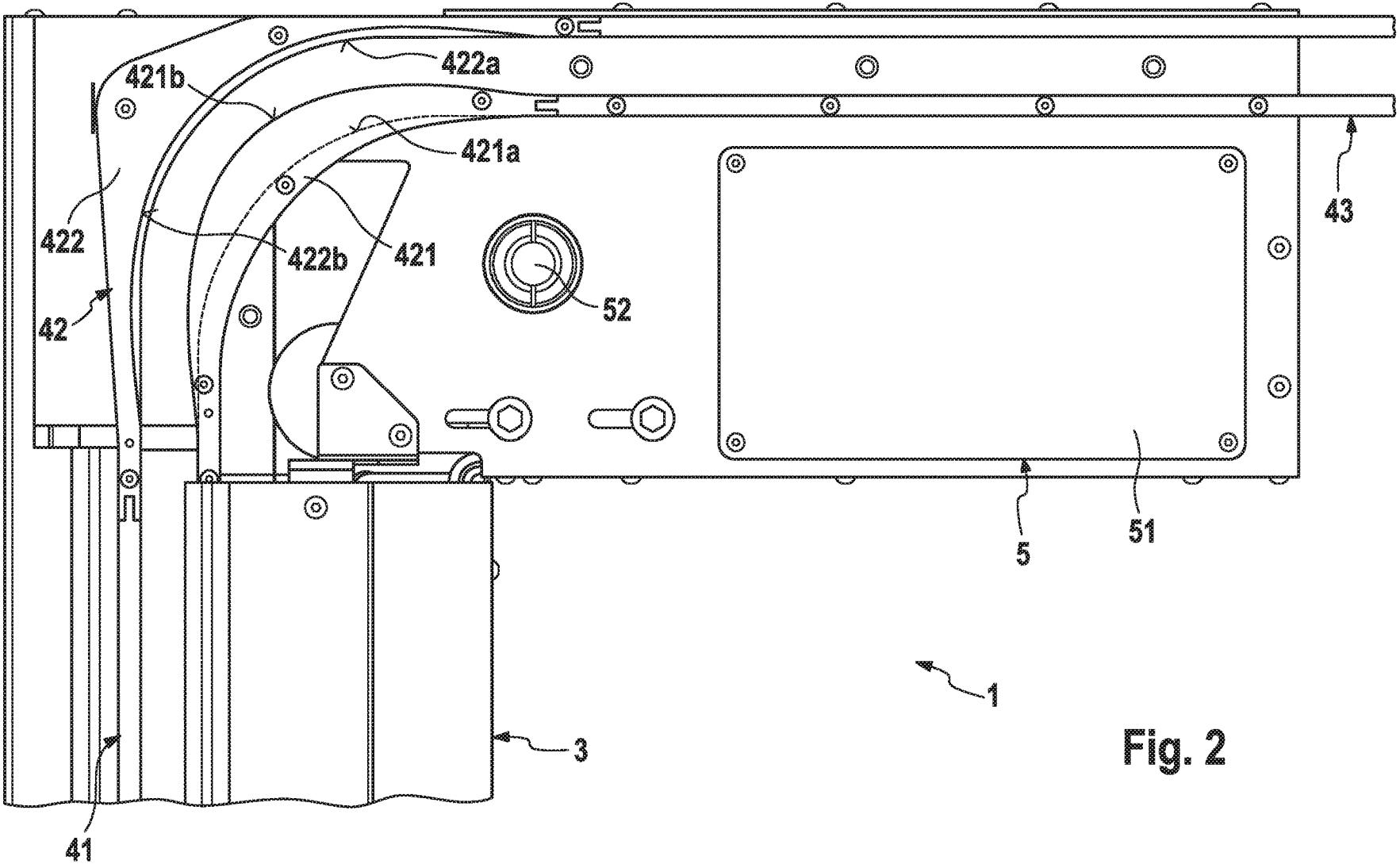
FIG. 2 is a detailed view of the illustration in FIG. 1 from which the transition portion of the guides results.

FIG. 2 shows a detailed view of the illustration in FIG. 1 which illustrates the transition portion 42 of the guide 4 more clearly. The door leaf 2 is, however, omitted here so as to ensure better overview.

The transition portion 42 comprises an inner guide element 421 and an outer guide element 422. They offer two respective guideways at the lateral ends of the door leaf 2 to the guide rollers which will be explained later, so that a part of the guide rollers rolls on the one guideway and the other part rolls on the other guideway.

At the inner guide element 421 this is the first inner guideway 421*a* which is concealed in the instant side view and is therefore shown in dashes, and the second inner guideway 421*b*. At the outer guide element 422 this is the first outer guideway 422*a* and the second outer guideway 422*b*. As may be seen from the illustration, the second inner guideway 421*b* and the second outer guideway 422*b* each extend radially outside of the assigned first guideway 421*a* and 422*a*. The cooperating of these guideways with the sections 21 of the door leaf 2 will be explained in detail later.

FIG. 2 further shows a motor 51 of the drive 5 and a drive shaft 52 by means of which the motor power is transmitted in a per se known manner from one side of the door to the other one.

Figure 3:
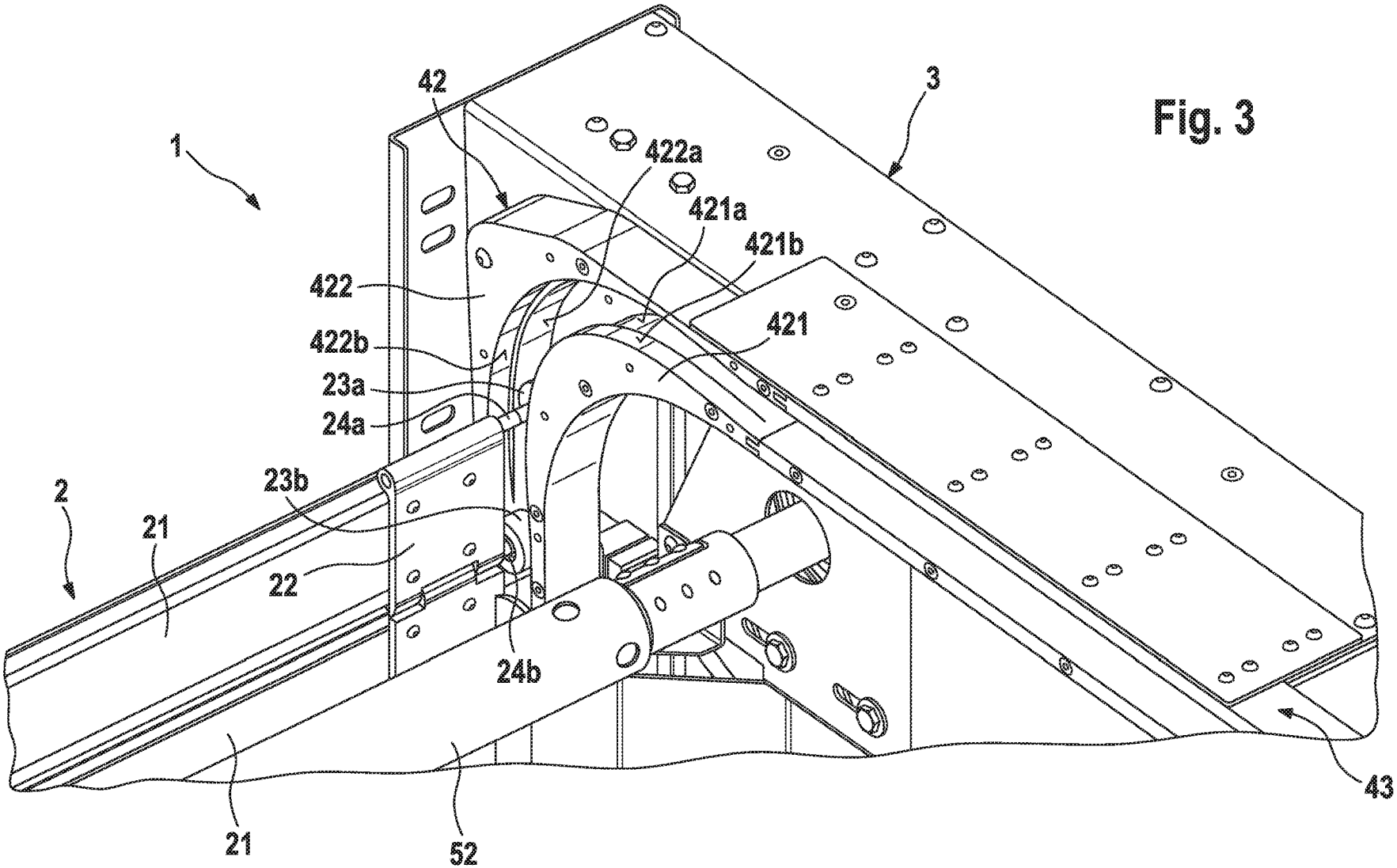
FIG. 3 is a perspective view of the illustration pursuant to FIG. 2.

A perspective view of the illustration pursuant to FIG. 2 is shown in FIG. 3. Especially the guideways 421*a*, 421*b*, 422*a*, and 422*b* can be seen more clearly here. Moreover, further details of the door leaf 2 may be seen.

It comprises a plurality of sections 21 which are adapted to be angled with respect to each other and which extend transversely across the door opening and are connected with each other on both sides in the end region by means of a strap hinge 22. In the hinge region guide rollers 23*a* and 23*b* are arranged which roll on rotation axes 24*a* and 24*b*. The rotation axes 24*a* and 24*b* are extensions of the hinge studs.

Figure 4:
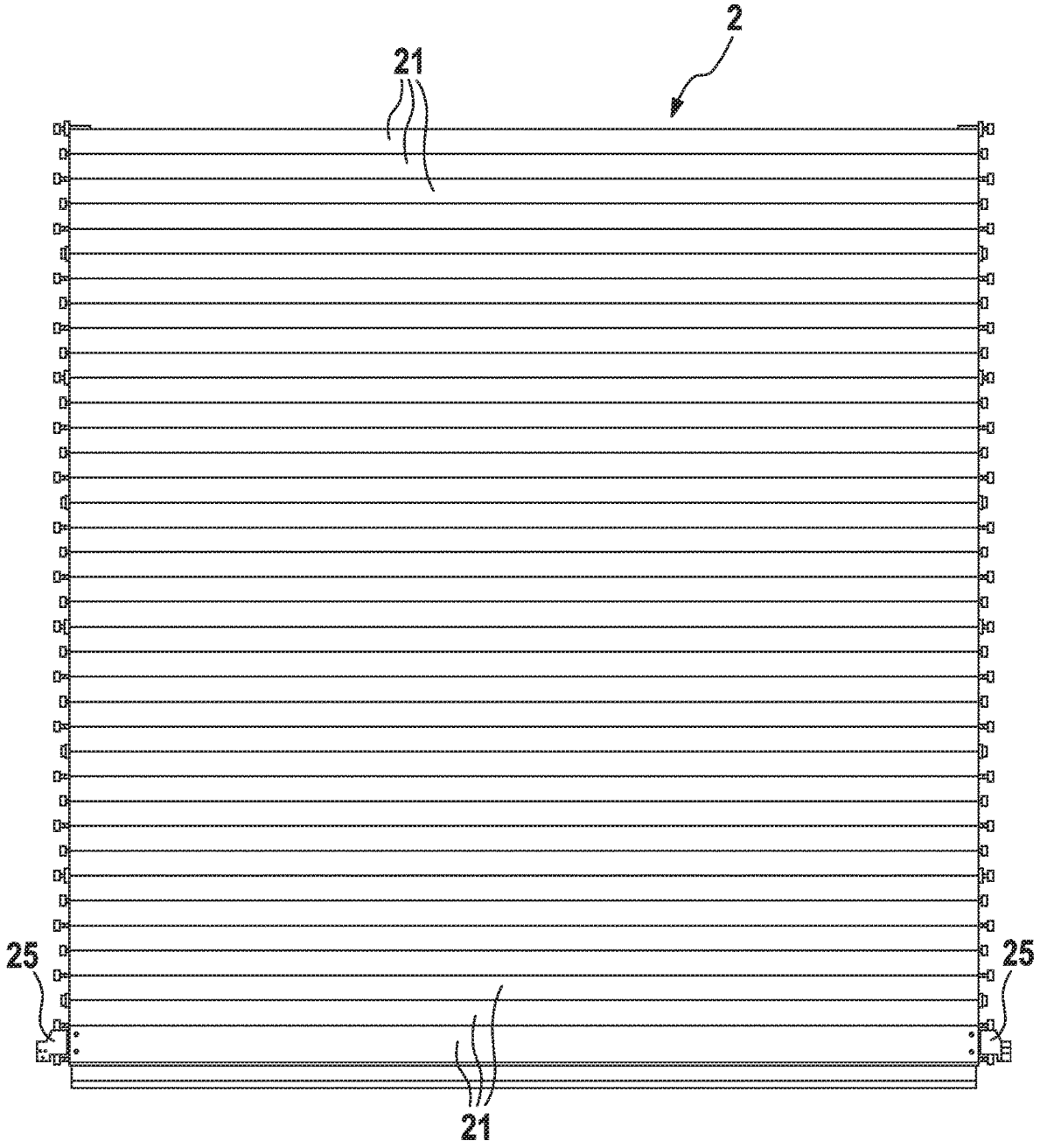
FIG. 4 is a front view of a door leaf of the roller shutter arrangement in accordance with the invention.
Figure 5:
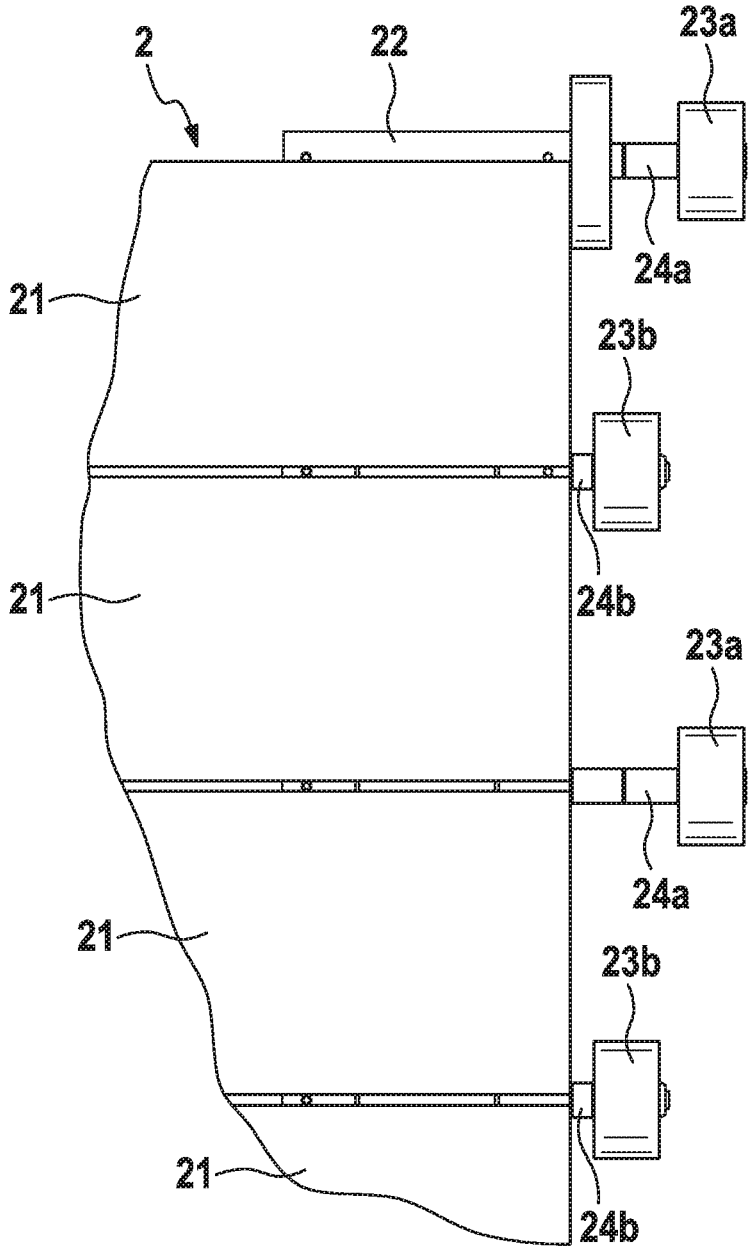
FIG. 5 is a detail from the view according to FIG. 4.
Figure 6:
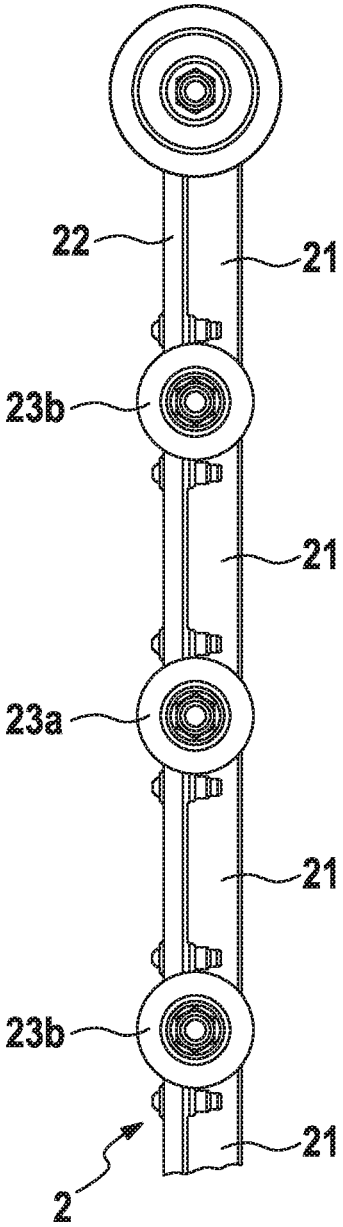
FIG. 6 is a side view of the detail from FIG. 5.

The construction of the door leaf 2 results in more detail from FIG. 4 which represents a front view thereof. From this, and from the detail pursuant to FIG. 5, it is clearly revealed that the guide rollers 23*a* are mounted on longer rotating axes 24*a* that the guide rollers 23*b* on the shorter rotating axes 24*b*. The guide rollers 23*a* are thus axially staggered from the guide rollers 23*b* in the region of the guide 4. In the effective diameter, however, the guide rollers 23*a* are identical to the guide rollers 23*b*, as can be seen from the side view pursuant to FIG. 6.

FIG. 4 further shows two engaging pieces 25 which are fastened on both sides on the door leaf at a bottom-side section 21. These engaging pieces 25 cooperate with the drive 5 such that the drive force is in this position transmitted to the door leaf 2 on both sides synchronously. For operation of the door leaf 2 the majority of the sections 21 is thus pushed into the storage portion 43 during opening. When closing the door leaf 2, however, it is pulled out of the storage portion 43 into the closed position in the end portion 41.

Figure 7:
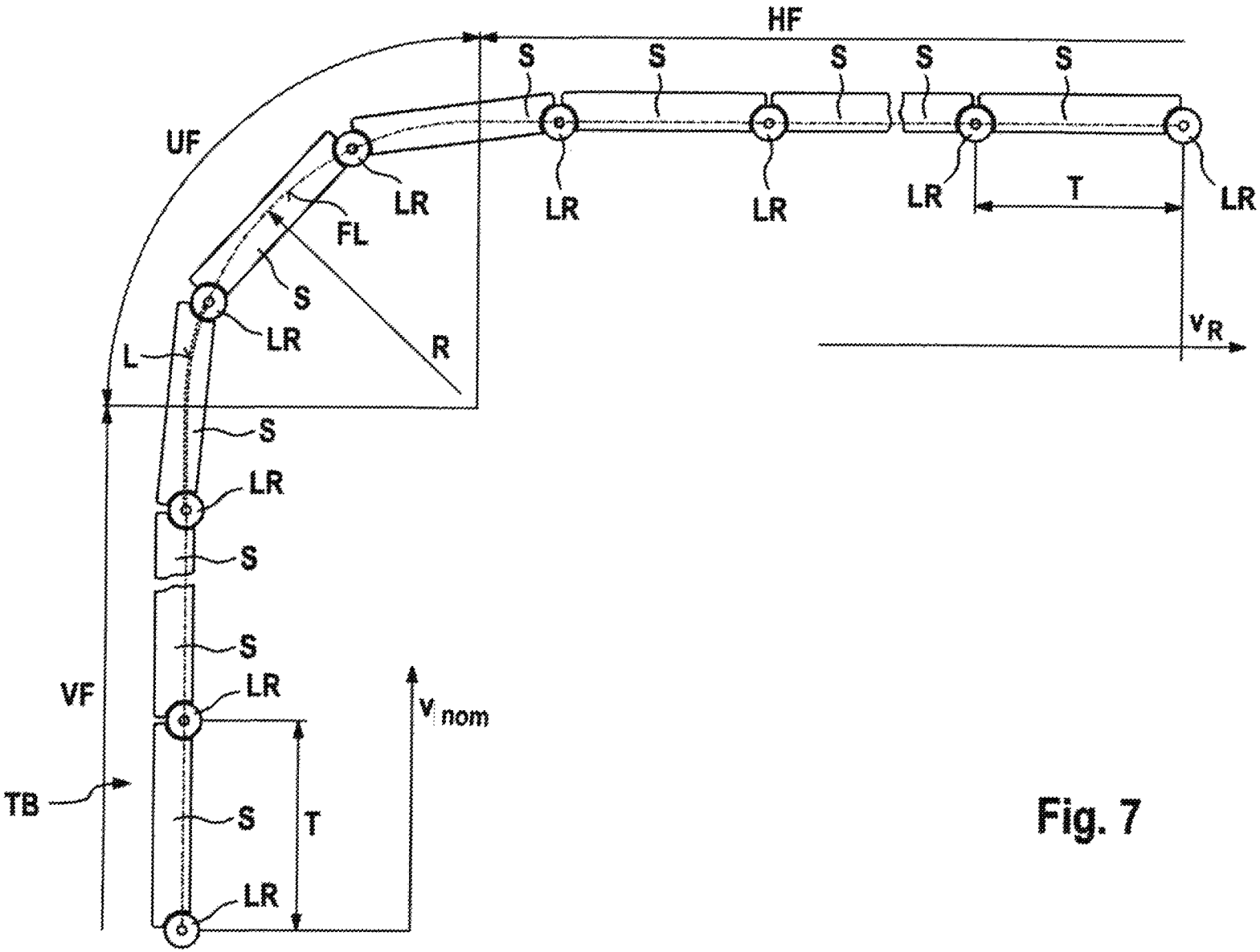
FIG. 7 is a schematic representation of the movement path of a door leaf of a conventional roller shutter arrangement.

For illustrating the essence of the instant invention, basic aspects will be introduced in the following first of all by means of a schematic representation of the movement path of a door leaf of a conventional roller shutter arrangement in FIG. 7:

FIG. 7 shows schematically a conventional door leaf TB of a plurality of sections S which are connected with each other in a manner adapted to be angled. The effective breadth of a section S defines the partition T of the door leaf 2 which is equivalent to the distance between two hinges which connect the sections S pivotally and/or the distance between two guide rollers LR.

This door leaf TB is guided laterally by means of the guide rollers LR in a guide which is not illustrated here and which is divided into vertical guide VF, transition guide UF, and horizontal guide HF. The vertical guide VF and the horizontal guide HF are of rectilinear design. The transition guide UF comprises a constant radius R and connects the vertical guide VF with the horizontal guide HF.

FIG. 7 further shows the guide path FL of this conventional door leaf TB, which is illustrated with dots and dashes. As may be recognized, an effective guide length L, which is illustrated with dots here, between two guide rollers LR is longer in the region of the transition guide UF than in the linear regions of the vertical guide VF and the horizontal guide HF, since it is not linear, but runs over a circular arc. The effective guide length L is therefore larger than the partition T.

The consequence of this is that a nominal speed vnom of, for instance, constantly 2 m/s in the instant embodiment, which is introduced via a section S is transferred, due to thrust, to the further sections S and appears at the other end of the door leaf, due to the polygonal effect, not equally, but is subject to substantial oscillation as a resulting speed vR. This is illustrated in the diagram pursuant to FIG. 8 which demonstrates the speed relative to the time.

Figure 9:
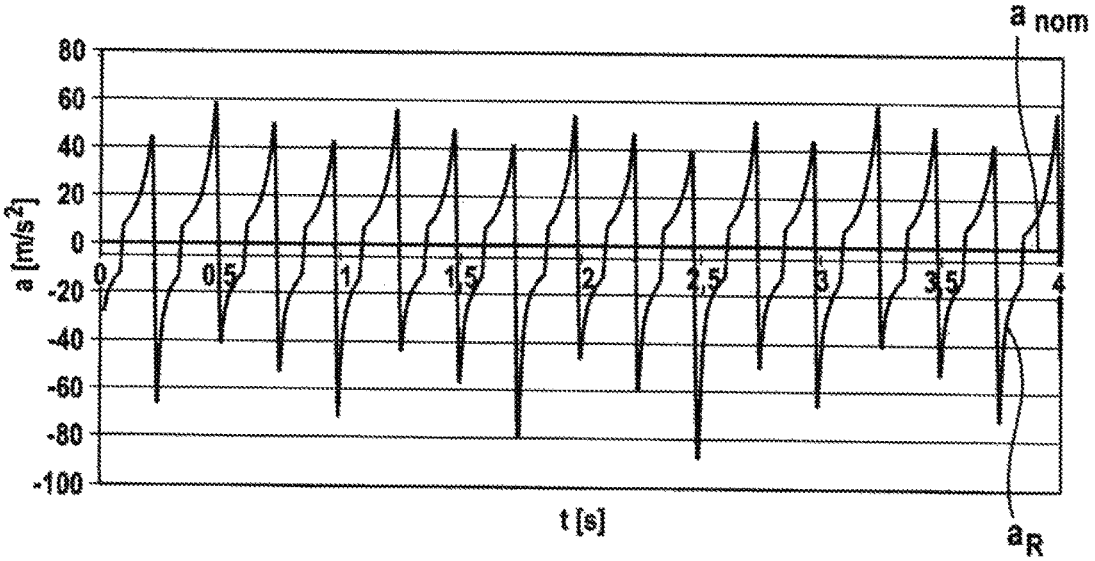
FIG. 9 is a diagram with a comparison of the accelerations with and without polygonal effect.

FIG. 9 shows the associated diagram of the effective accelerations relative to the time, which act on the sections S of the door leaf TB. Without the influence of a polygonal effect a nominal acceleration in the movement direction $a_{nom}$ of 0 $m/s^2$ would be given. Due to the polygonal effect, however, accelerations and decelerations occur which are reflected in the diagram in the resulting acceleration $a_R$.

Figure 10:
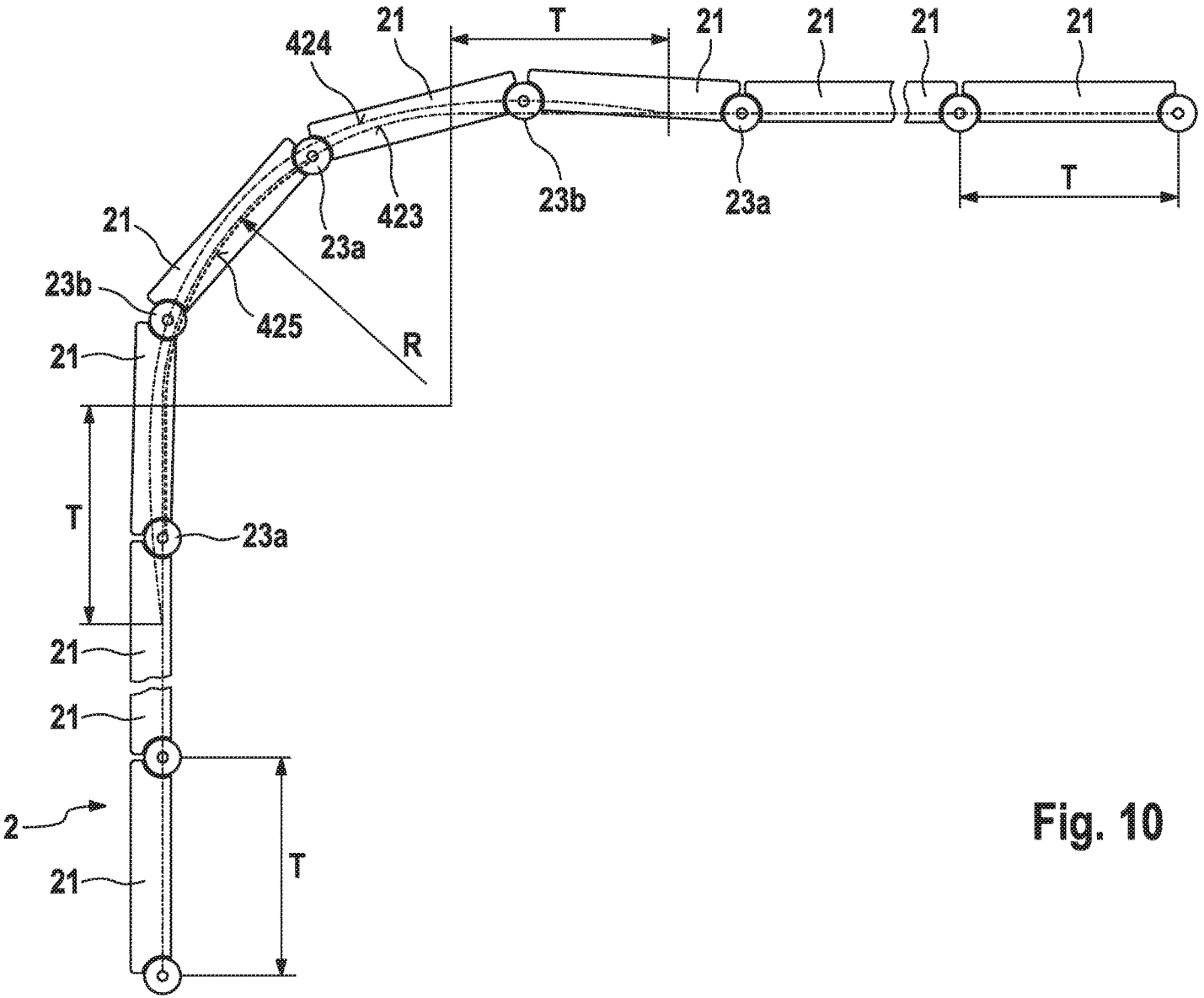
FIG. 10 is a schematic representation of the movement path of a door leaf in accordance with a first embodiment of the invention.

The instant invention provides a different kind of guide in the region of the transition portion 42. As was especially illustrated by means of FIGS. 2 and 3 already, the transition portion 42 comprises the inner guide element 421 and the outer guide element 422 which provide, due to the design of their guideways, two guide paths 423 and 424. In FIG. 10 this is shown schematically in a side view. The first guide path 423 corresponds in the illustrated first embodiment to a conventional guide path in a transition guide with a constant radius, as it may be seen in FIG. 7, while, in accordance with the invention, the second guide path 424 is added which is available radially outside thereof. In the instant embodiment the second guide path 424 moreover does not only extend to the transition portion 42, but extends by the magnitude of the partition T into the end portion 41 and the storage portion 43.

This reveals that the guide rollers 23*a* and 23*b* are guided in the region of the transition portion 42 alternately on the first guide path 423 and the second guide path 424. The guide rollers 23*a* follow the first guide path 423 and the guide rollers 23*b* follow the second guide path 424. In other words, the sections 21 here kink extraordinarily against each other reciprocally in a predetermined manner, so that a guide length 425 (which is illustrated with dots here) of two consecutive guide rollers 23*a* on a guide path 423 has a magnitude corresponding to twice the partition T.

Figure 8:
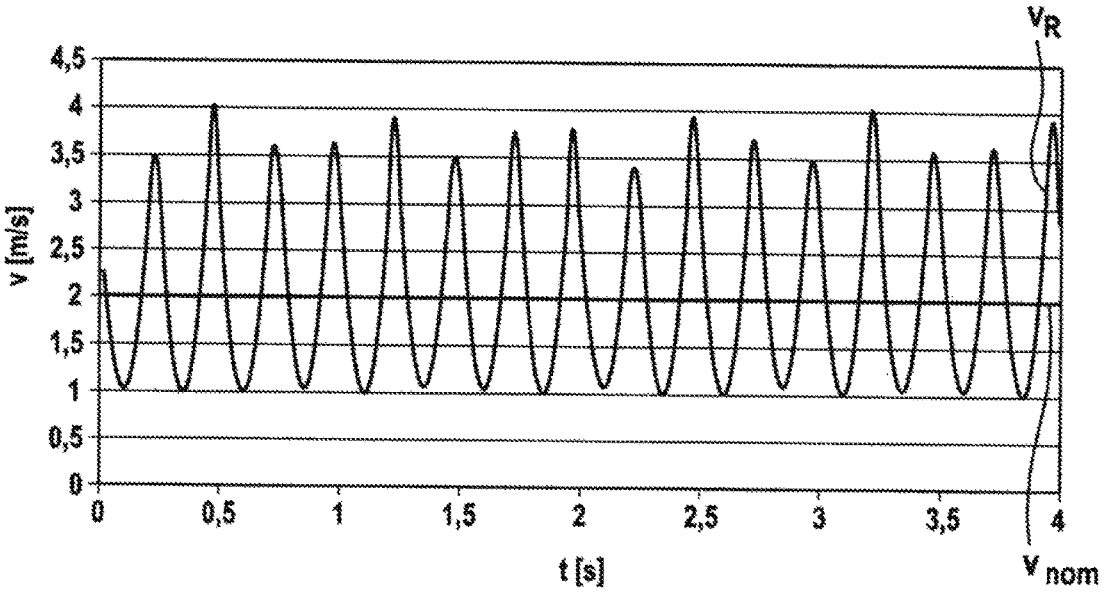
FIG. 8 is a diagram with a comparison of the movement speeds with and without polygonal effect.

Thus, the sections 21 of the door leaf 2 are, even in the transition portion 42, not subject to an efficient extension of their movement path, so that the polygonal effect can be suppressed and/or prevented here. Oscillations of speed and/or acceleration, as they are illustrated in FIGS. 8 and 9 for the state of the art, can thus be avoided.

Figure 11:
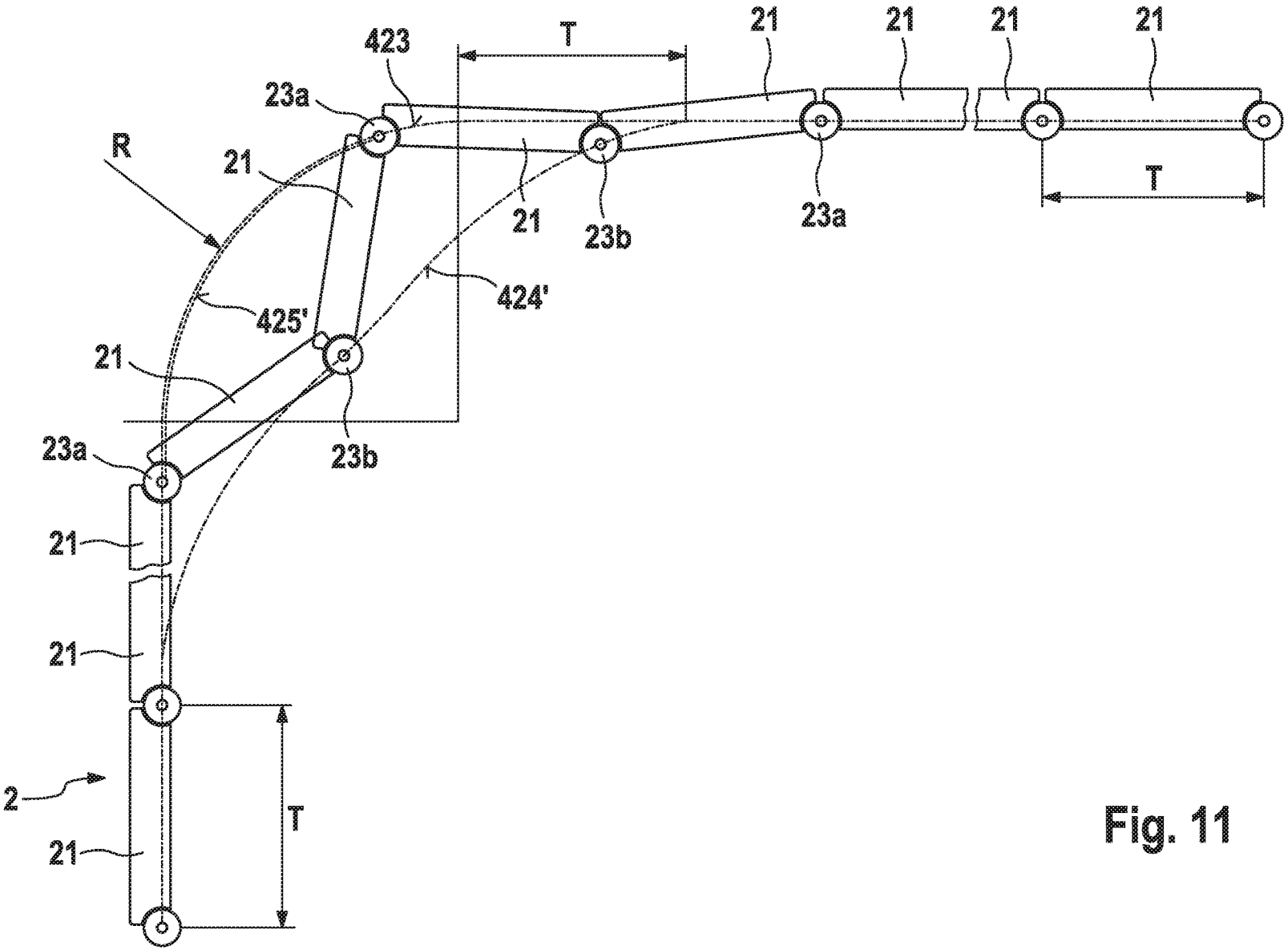
FIG. 11 is a schematic representation of the movement path of a door leaf in accordance with a second embodiment of the invention.

A modified second embodiment of the instant invention is shown in FIG. 11. It differs from the embodiment pursuant to FIG. 10 only in that a second guide path 424' is available radially inside of the first guide path 423. The further details of this arrangement correspond to that of the first embodiment, which is why the same reference numbers are used for the corresponding elements.

Here, too, the sections 21 kink extraordinarily against each other reciprocally in a predetermined manner, so that the guide length 425' (which is illustrated with dots here again) of two consecutive guide rollers 23*a* on a guide path 423 has a magnitude corresponding to twice the partition T. The polygonal effect can likewise be suppressed here.

Figure 12:
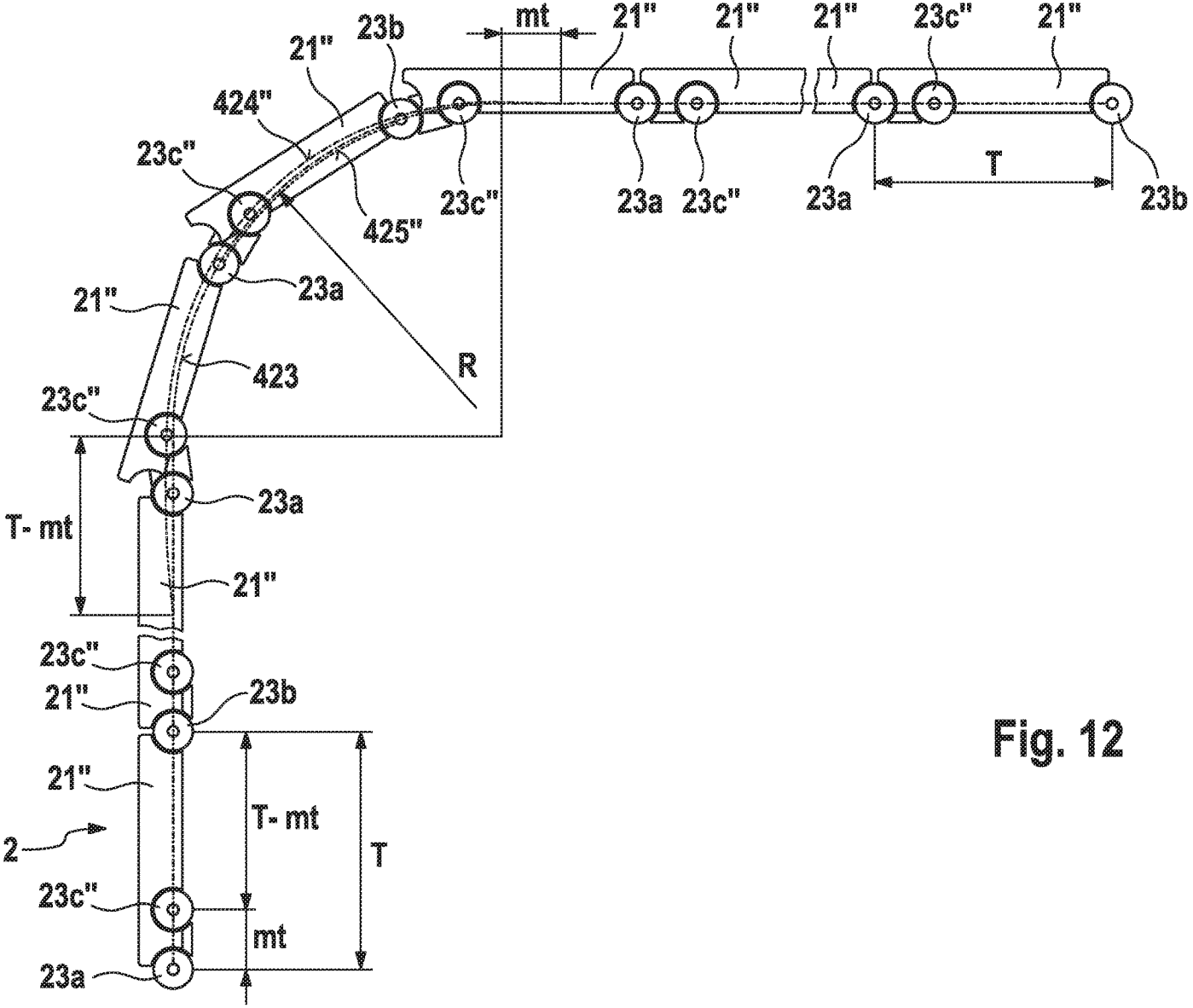
FIG. 12 is a schematic representation of the movement path of a door leaf in accordance with a third embodiment of the invention.

In FIG. 12 a third embodiment of the invention is shown. Here, the sections 21" comprise, in addition to their edge-side guide rollers 23*a* and 23*b*, an additional guide roller 23*c"* positioned therebetween and coupled to a hinge which is not illustrated here in detail. It is spaced apart from the guide roller 23*a* by a predetermined magnitude mt. In this manner a section 21" may, within its per se determined breadth, additionally be angled in a predetermined manner, so that a smaller section breadth becomes effective in the transition portion 42. The additional guide roller 23*c"* runs on a second guide path 424". The latter may then get even closer to the first guide path 423, but is positioned radially outside thereof.

The effective guide length 425" between two guide rollers 23*a* and 23*b*, which is drawn in dots, thus corresponds to the partition T. Also in this manner the polygonal effect may be suppressed.

Figure 13:
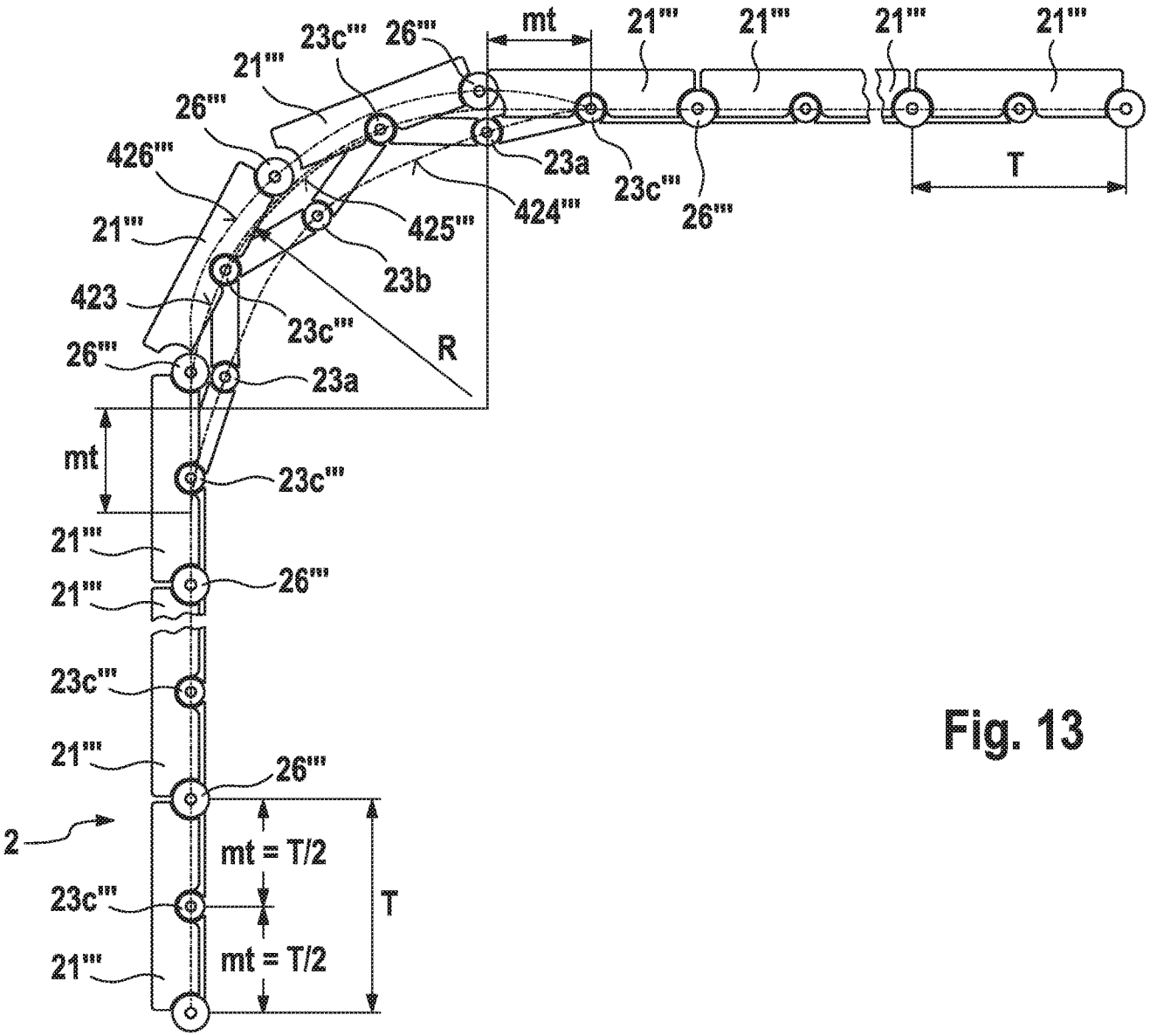
FIG. 13 is a schematic representation of the movement path of a door leaf in accordance with a fourth embodiment of the invention.

FIG. 13 shows a fourth embodiment of the invention. The sections 21''' comprise, in addition to their edge-side guide rollers 23*a* and 23*b*, an additional guide roller 23*c'''* which is positioned therebetween preferably in the middle and with a magnitude mt=T/2 and is coupled to a hinge which is not illustrated in detail, such that both edge-side guide rollers 23*a* and 23*b* are adapted to be pivoted relative thereto. A remaining pivot axis 26''' between two adjacent sections 21''', which continues to connect the sections 21''' directly, then forms in the transition portion 42, together with two additional guide rollers 23*c'''* and a guide roller 23*a* or 23*b*, a shape in accordance with an articulated quadrangle.

In this manner a section 21''' can again be angled within its per se fixed breadth, so that a smaller section width becomes effective in the transition portion 42. The additional guide roller 23*c'''* runs on the first guide path 423 while the guide rollers 23*a* and 23*b* run on a second guide path 424'''. The latter is radially inside of the first guide path 423. The pivot axes 26''' in turn run on a further guide path 426''' radially outside of the first guide path 423.

The effective guide length 425''' between two guide rollers 23*c'''*, which is again drawn in dots, then corresponds to the partition T. Also in this manner the polygonal effect may be suppressed.

In all of these embodiments the guide rollers are guided in the region of the end portion 41 and of the storage portion 43 in the conventional manner on a joint guideway.

In addition to the embodiments illustrated, the invention permits further design approaches.

Thus, it is also possible that more than two guideways which are laterally staggered with respect to each other are formed at the transition portion. For this purpose the guide rollers 23*a* or 23*b* may, for instance, also be configured as double rollers, wherein the individual rollers are spaced apart from each other, but on a joint rotating axis, and thus each cooperate with guideways which encompass the other guideway of the respectively other guide rollers on both sides. This makes it possible to achieve higher running smoothness. Furthermore, it is basically also possible to design three or more separate guideways.

In the illustrated embodiment one of the guide paths followed, in the transition portion of the guides, a constant transition radius between the end portion and the storage portion of the guides. This is, however, not mandatorily necessary. It is also possible to provide one of the guideways radially outside thereof, and the other one radially inside thereof. In the end, the guideways may be configured more or less arbitrarily with respect to a transition path predetermined by the transition radius. The design of the guide paths is then calculated from the transition path and the partition T.

Furthermore, the bearing portion of the guides need not necessarily be formed rectilinear, either. It is, for instance, also possible to provide an elongate or circular reel for accommodating the door leaf, as they are known from DE 40 15 215 A1 and from WO 00/60208 A1. Bearing portions with other forms or variations of radii are also possible.

The drive force of the drive 5 need not necessarily be transmitted to the door leaf at the lower, bottom-side door leaf element. The introduction of force may also take place at the upper end of the door leaf or in some other suitable place with the suitable means.

The roller shutter arrangement in accordance with the invention is not restricted to be designed as a quickly moving lifting door. It may also be used in other situations of installations as long as the end portion 41 and the storage portion 43 are positioned at any angle relative to each other. Moreover, it is also possible to seal production areas, processing centers, etc. within factory halls or the like from the environment.

While specific embodiments of the invention have been shown and described in detail to illustrate the application of the principles of the invention, it will be understood that the invention may be embodied otherwise without departing from such principles.

The invention claimed is:

1. A roller shutter arrangement comprising: a door leaf comprising door sections which are connected with each other allowing the sections to be angled relative to each other;

guide rollers;

lateral guides, the door sections each being guided in the lateral guides by means of the guide rollers, wherein the door leaf is motor-driven by, a drive and is movable to and fro between an open position and a closed position, wherein the lateral guides each comprise an end portion in which the door leaf is accommodated in the closed position for closing a door opening, a transition portion, and a storage portion in which the door leaf is accommodated in the open position, and wherein the end portion and the storage portion are angled with respect to each other and are connected with each other via the transition portion, wherein the transition portion provides at least two respective guide paths along which predetermined guide rollers of said guide rollers of each door section alternately roll, the two guide paths being located laterally adjacent to each other, so that on respective guide lines a guide length between two guide rollers corresponds substantially to a partition of the door leaf defined by a breadth of a door section or to an integer multiple thereof, at least a portion of one of the at least two respective guide paths having a first radius, at least a portion of another one of the at least two respective guide paths having a second radius, the first radius being different from the second radius.

2. The roller shutter arrangement according to claim 1, wherein the transition portion of the lateral guides comprises at least two respective guideways arranged to be staggered laterally with respect to each other, wherein the predetermined guide rollers at the door sections are correspondingly staggered axially with respect to each other and engage in an assigned guideway of the at least two respective guideways, wherein at least two of the predetermined guide rollers for moving along the one of the at least two respective guide paths are located at a position laterally beyond at least one of the predetermined guide rollers for moving along the another one of the at least two respective guide paths, the at least one of the predetermined guide rollers being located axially between one of the at least two of the predetermined guide rollers and another one of the at least two of the predetermined guide rollers.

3. The roller arrangement according to claim 1, wherein the transition portion comprises a guide roller guideway and another guideway, the door sections comprise hinges and additional guide rollers which are adapted to be angled by means of the hinges with respect to adjacent said guide rollers of the door section and the additional guide rollers roll, in the transition portion, on the another guideway, which another guideway is different than the guide roller guideway for the adjacent guide rollers.

4. The roller arrangement according to claim 1, wherein one of the guide paths, in the transition portion of the guides, follows a constant transition radius between the end portion and the storage portion of the guides.

5. The roller arrangement according to claim 1, wherein one of the guide paths is, in the transition portion of the lateral guides, radially outside of a constant transition radius between the end portion and the storage portion of the lateral guides.

6. The roller arrangement according to claim 1, wherein one of the guide paths is, in the transition portion of the lateral guides, radially inside of a constant transition radius between the end portion and the storage portion of the lateral guides.

7. The roller arrangement according to claim 1, wherein the storage portion of the lateral guides is configured to be rectilinear.

8. The roller arrangement according to claim 1, wherein the drive transmits the drive force to the door leaf in a region of one of the door sections.

9. The roller arrangement according to claim 8, wherein the drive transmits the drive force to the door leaf at a bottom-side door section.

10. The roller arrangement according to claim 1, wherein the roller arrangement is configured as a lifting door.

11. A roller shutter arrangement comprising: a door leaf comprising door sections which are connected with each other allowing the door sections to be angled relative to each other; first guide rollers located on one side of the door leaf; second guide rollers located on the one side of the door leaf, each of the plurality of first guide ropers being located at a position laterally beyond a position of each of the second guide rollers, each of the door sections being associated with at least one of the first guide rollers and at least one of the second guide rollers; lateral guides, the door sections each being guided in the lateral guides by the first guide rollers and the second guide rollers, wherein the door leaf is motor-driven by a drive and is movable to and fro between an open position and a closed position, wherein each of the lateral guides comprises an end portion in which the door leaf is accommodated in the closed position for closing a door opening, a transition portion, and a storage portion in which the door leaf is accommodated in the open position, the end portion and the storage portion being angled with respect to each other and are connected with each other via the transition portion, the transition portion of at least one of the lateral guides comprising at least a first guide path and a second guide path, each of the first guide rollers being aligned with the first guide path, each of the second guide rollers being aligned with the second guide path, the first guide path being located laterally adjacent the second guide path, at least a portion of the first guide path comprising a first guide path radius, at least a portion of the second guide path comprising a second guide path radius, the first guide path radius being different from the second guide path radius.

12. The roller arrangement according to claim 11, wherein the first guide rollers and the second guide rollers are alternately arranged along a length of the door leaf, the first guide rollers comprising a first guide first roller and a first guide second roller, the second guide rollers comprising a second guide first roller, the second guide first roller being located axially between the first guide first roller and the first guide second roller, wherein the length of the door leaf extends from one end of the door leaf to another end of the door leaf, wherein a guide length between one of the first guide rollers and one of the second guide ropers associated with one of the door sections corresponds substantially to a partition of the door leaf defined by a breadth of one of the door sections or to an integer multiple thereof.

13. The roller arrangement according to claim 11, wherein each portion of the first guide path is located laterally adjacent to the second guide path.

14. A roller shutter arrangement comprising: a door leaf comprising door sections which are connected with each other allowing the door sections to be angled relative to each other; guide rollers; lateral guides, the door sections each being guided in the lateral guides by the guide rollers, wherein the door leaf is motor-driven by a drive and is movable to and fro between an open position and a closed position, wherein each of the lateral guides comprises an end portion in which the door leaf is accommodated in the closed position for closing a door opening, a transition portion, and a storage portion in which the door leaf is accommodated in the open position, and wherein the end portion and the storage portion are angled with respect to each other and are connected with each other via the transition portion, wherein the transition portion provides at least a first guide path and a second guide path along which predetermined guide rollers of the guide rollers roll, the first guide path being located laterally adjacent the second guide path, the first guide path comprising a first guide path portion having a first guide path portion radius, the second guide path comprising a second guide path portion having a second guide path portion radius, the second guide path portion radius being different from the first guide path portion radius.

15. The roller arrangement according to claim 14, wherein the predetermined guide rollers of each door section alternately roll along the first guide path and the second guide path, so that a guide length between two guide rollers corresponds substantially to a partition of the door leaf defined by a breadth of one of the door sections or to an integer multiple thereof.

16. The roller shutter arrangement according to claim 14, wherein the transition portion of the lateral guides comprises at least two respective guideways arranged to be staggered laterally with respect to each other, wherein the predetermined guide rollers at the door sections are correspondingly staggered axially with respect to each other and engage in an assigned guideway of the at least two respective guideways, wherein at least two of the predetermined guide rollers for moving along the first guide path are located at a position laterally beyond at least one of the predetermined guide rollers for moving along the second guide path, the at least one of the predetermined guide rollers being located axially between one of the at least two of the predetermined guide rollers and another one of the at least two of the predetermined guide rollers.

17. The roller arrangement according to claim 14, wherein the transition portion comprises a guide roller guideway and another guideway, the door sections comprising hinges and additional guide rollers which are adapted to be angled by means of the hinges with respect to adjacent the guide rollers of the door section and the additional guide rollers roll, in the transition portion, on the another guideway; which another guideway is different than the guide roller guideway for the adjacent guide rollers.

18. The roller arrangement according to claim 14, wherein one of the first guide path and the second guide path, in the transition portion of the lateral guides, follows a constant transition radius between the end portion and the storage portion of the lateral guides.

19. The roller arrangement according to claim 14, wherein one of the first guide path and the second guide path is, in the transition portion of the lateral guides, radially outside of a constant transition radius between the end portion and the storage portion of the lateral guides.

20. The roller arrangement according to claim 14, wherein one of the first guide path and the second guide path is, in the transition portion of the lateral guides, radially inside of a constant transition radius between the end portion and the storage portion of the lateral guides.

* * * * *